United States Patent [19]

Schmitz

[11] Patent Number: 4,729,347

[45] Date of Patent: Mar. 8, 1988

[54] INTERNAL COMBUSTION CHAMBER

[76] Inventor: Donald L. Schmitz, P.O. Box 19536, San Diego, Calif. 92119

[21] Appl. No.: 906,457

[22] Filed: Oct. 27, 1986

[51] Int. Cl.[4] ..... F01P 3/02

[52] U.S. Cl. ..... 123/41.74; 123/41.84; 92/171

[58] Field of Search ..... 123/41.83, 41.84, 41.72, 123/41.74, 193 C; 92/171

[56] References Cited

U.S. PATENT DOCUMENTS

| | | | |
|---|---|---|---|
| 1,309,103 | 7/1919 | Rowledge | 123/41.84 |
| 3,744,462 | 7/1973 | Herschmann et al. | 123/41.72 |
| 4,554,893 | 11/1985 | Vecellio | 123/41.83 |

FOREIGN PATENT DOCUMENTS

| | | | |
|---|---|---|---|
| 1060190 | 6/1959 | Fed. Rep. of Germany | 123/41.84 |

*Primary Examiner*—William H. Cuchlinski, Jr.
*Attorney, Agent, or Firm*—Charmasson & Holz

[57] ABSTRACT

A hung combustion chamber for internal combustion engines comprising a cylinder and detachable cooling jacket welded to a cylinder head. The cylinder and the cooling jacket are within a cylinder block, but unsupported by the cylinder block. Coolant is supplied to the jacket by a non-rigid connection. The hung combustion chamber contains the combustion gas pressures and temperatures while the jacket contains the coolant flows, eliminating many gaskets, seals, attachment and alignment components. The simplified one-piece chamber construction and limited number of components reduce stress concentration points and hot spots. The hung combustion chamber is particularly applicable to the retrofitting of existing worn diesel engines in heavy duty service environments.

9 Claims, 4 Drawing Figures

FIG. 2
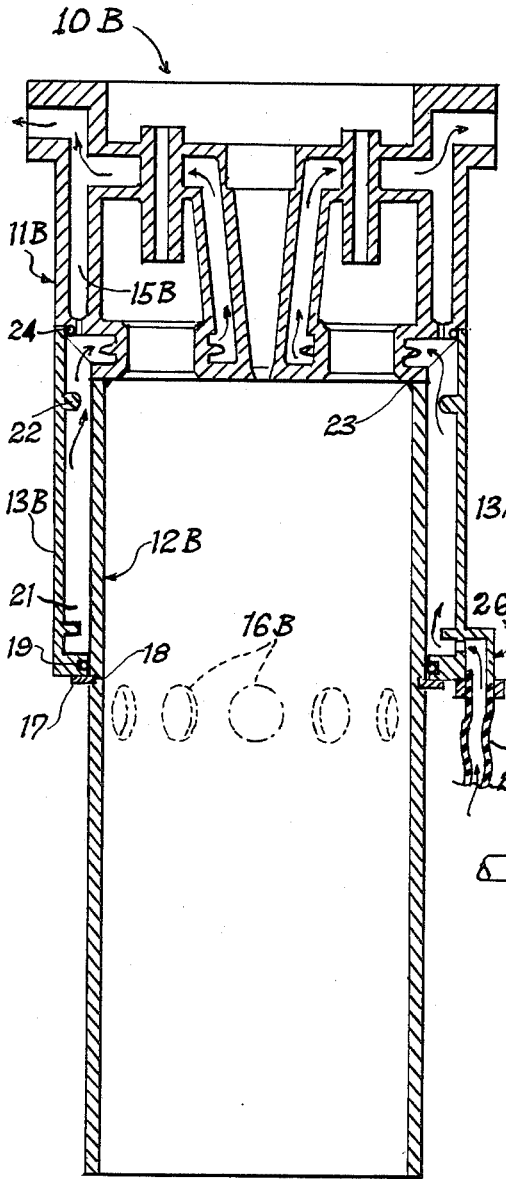
FIG. 1
PRIOR ART
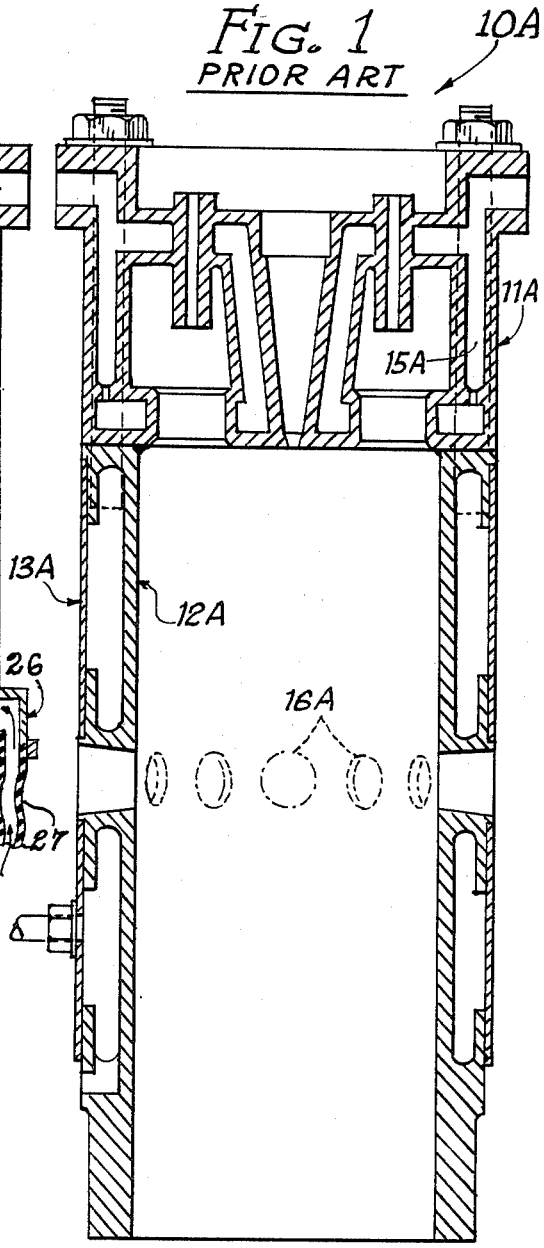
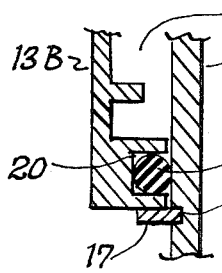
FIG. 3
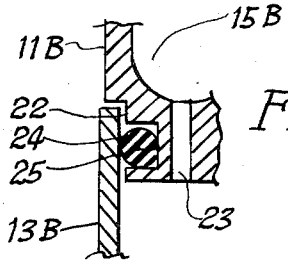
FIG. 4

INTERNAL COMBUSTION CHAMBER

FIELD OF THE INVENTION

This invention relates to internal combustion engines, and more specifically to combustion chamber and cooling jacket construction.

BACKGROUND OF THE INVENTION

The presently existing basic design of high-powered combustion engines consists of two main cast components: the cylinder block and the cylinder head. Bored out cylinders in the block and portions of the head form combustion chambers. The function of the combustion chamber is to contain the firing pressure, to pressurize the piston crown, guide the piston and transfer the absorbed combustion heat to a coolant.

One existing design involves the use of a separate cylinder liner and coolant jacket with numerous mechanical joints, seals and other attachment components to secure the cylinder head to the liner. In one current commercial diesel engine of this design, a total of 42 components are used to join, seal and position the liner, jacket, cylinder head and block. These components are primarily required to seal and withstand the high combustion pressures and temperatures, as well as provide aligned and leak tight passages for coolant flows acting between the block and head. These attachment, sealing and alignment components are generally the highest stress and highest temperature points in the engine. A careful design, trading increased material in some areas (to lower the stress) with decreased material in other areas (to lower temperature by reducing resistance to heat transfer) must be accomplished.

For engines required for long term operation or heavy-duty service, various components have been made replaceable. Materials have also been substituted for the traditional cast iron. Of specific interest among these components are steel liners. Centrifugal casting and careful material selection is able to significantly improve wear resistance at a moderate cost increase, but additional seals, collars and machining of the block for sealing surfaces is again required.

Liners have also been used as a retrofit in previously unlined cylinders to add life. The worn cylinder block is bored to a larger diameter and a steel liner inserted. This could only be accomplished in cylinder block with thick walls capable of being bored out. Again, additional seals, collars and machining operations are required.

Although steel liners have significant strength and wear life advantages in new and retrofit applications, they can create additional cooling problems. Cooling is one of the primary functions of the cylinder wall since few engineering materials can withstand combustion flame temperatures. This liner, when backed by the cylinder without direct cooling, now presents an additional resistance to heat flow. Especially at the interface between the liner and block. The additional collars, retainers and seals causes hot spots and resistance to heat flow. The seals may also require lower temperatures to function properly, further compounding the cooling problems. In a retrofit application, these added cooling and other components require space, which can reduce displacement and performance.

In addition to the direct cooling problems caused by traditional liners and related hardware, differential thermal expansion can cause additional stress. The additional resistance to heat flow at seals, retainers and joints results in temperature differences at different points in the liner and block. Because of thermal expansion in the liner and associated hardware, the support by the block creates additional stresses.

Although one-piece combustion chamber construction is not new, it has been avoided in the past. Reasons for avoiding one piece construction include manufacturing cost (machining access to valve seats, guides, cylinder bore), material incompatibility (cast iron is not generally weldable) and cooling. Differential thermal expansion can create large stress in one-piece combustion chambers unless uniformly cooled. Casting tolerances, weld beads, and ports create discontinuities leading to hot spots.

One of the most important reasons for not using one-piece construction is the constraints on repair/replacement. Access to high wear/deposit areas, such as valves, pistons, valve seats and cylinders, is necessary for long term performance. One-piece construction limits access to these critical areas.

Simply welding liners to the head would eliminate many pieces of attaching equipment but would result in difficult, if not impossible cooling problems. Liner thickness would have to be significant in order to withstand high thermal and differential stresses.

Welded liners would have additional problems in a retrofit application. Tolerances on the liner and bored out cylinder would require perfect alignment, roundness and positioning. Because of increased resistance to heat flow, differential thermal stresses would be increased. If the internal combustion engine is a two cycle design with air intake ports in the cylinder wall, retrofit with a liner now also requires air seals and rotational alignment of the liner.

In summary, prior art one-piece combustion chamber engines cannot be easily repaired/replaced, while cylinders bored within blocks or liners attached to blocks require many gaskets, seals, attachment and alignment components. These components reduce reliability and add cost and time to assembly/disassembly procedures. The components also produce stress concentration points and hot spots requiring increased weight and cooling system performance.

SUMMARY OF THE INVENTION

The principal and secondary objects of this invention are:

- to create a repairable one-piece chamber;
- to reduce the sealing, attachment and alignment components required on a head and block construction;
- to reduce engine cost;
- to reduce engine assembly/disassembly time;
- to provide retrofitting of worn-out engine cylinders by substitution;
- to improve engine reliability;
- to increase engine displacement;
- to reduce stress concentrations; and
- to reduce hot spots for both two and four cycle engines.

These and other objects are achieved by welding a cylinder to a weldable cylinder head, creating a one-piece hung combustion chamber unsupported by, but within the cylinder block. Detachably sealed to and supported by the cylinder head and cylinder is a cooling jacket. Coolant is supplied to the space between the jacket and cylinder by a non-rigid connection or reservoir port. The one-piece combustion chamber contains the piston and combustion gas pressures and temperatures. The jacket provides uniform coolant flows to the cylinder unobstructed by engine block supports, seals or attachments.

BRIEF DESCRIPTION OF THE DRAWINGS

FIG. 1 is a diagrammatic cross-section of an existing internal combustion engine cylinder;

FIG. 2 is a diagrammatic cross-section of the present invention;

FIG. 3 is a section of the cooling jacket detachable seal and support to the cylinder; and FIG. 4 is a section of the cooling jacket seal to the cylinder head.

DESCRIPTION OF THE PREFERRED EMBODIMENT OF THE INVENTION

The improvement presently disclosed is better understood by comparing the invention to existing internal combustion chamber which is separate from the block shown in FIG. 1.

The basic configuration of an existing separate internal combustion cylinder 10A is illustrated in FIG. 1 and comprises a two cycle cylinder head 11A, a liner 12A and a water jacket 13A.

The cylinder head 11A and the liner 12A are made of cast iron. The cylinder head 11A and the liner 12A are connected by means of bolts, washers, nuts, studs, seals and gaskets, the number of which currently exceeds forty (40) on a diesel engine manufactured by General Motors. Each of those parts represents a potential point of failure.

The water jacket 13A is brazed to the liner 12A. The brazing requires significant assembly time to assure a reliable water seal.

The present invention is illustrated in FIG. 2 and comprises a cylinder head 11B, a cylinder 12B and a coolant jacket 13B. Both the cylinder head 11B and the cylinder 12B are made of steel, preferably mild steel, and joined by conventional welding, preferably inertia welding. The cylinder 12B can be made quickly and cost effectively by cutting seamless or welded tubing. Tubing would then be grooved for a retainer ring, and the interior surface hardened and brush honed.

The coolant cylinder 13B provides a passage for coolant around the combustion cylinder, 12B connecting to coolant passages 15B in the head 11B. The coolant cylinder 13B extends only to just prior to intake ports 16B. Intake air provides adequate cooling beyond the coolant cylinder 13B in conjunction with new material properties.

Retainer 17 is placed in groove 18 machined into the exterior wall of cylinder 12B. Retainer 17 provides detachable support for coolant jacket 13B. Coolant to the cooling jacket is supplied by fitting 26 and flexible hose 27. The flexible hose 27 may be deleted if within a pressurized coolant reservoir. Within the coolant jacket, an initial restriction 21 distributes the flow around the cylinder 12B. A second restriction 22 near the head 11B creates turbulence to maximize heat transfer near weld 23 which joins cylinder 12B with head 11B. The weld can be accomplished by many conventional means but impact or inertia welding is preferred.

FIG. 3 is a sectional view of the lower portion of the coolant jacket, retainer and lower seal. Retainer 17 is fitted to groove 18 in the cylinder 12B. Removal of retainer 17 allows coolant jacket 13B to be disassembled by sliding down cylinder 12B. A first elastomeric O-ring 19 is placed in jacket recess 20 which is in contact with and compressed by cylinder 12B and coolant jacket 13B forming a seal to the jacket coolant cavity 21.

FIG. 4 is a sectional view of the upper portion of the coolant jacket 13B and cylinder head 11B and upper seal. A machined cylindrical surface 22 on head 11B is slightly smaller in diameter than the inside diameter of cylinder 13B. Passage 23 interconnects jacket coolant cavity 21 with head coolant cavity 15B. Seal is effected by a second elastomeric O-ring 24 being placed in head recess 25 in contact with and compressed by coolant jacket 13B and head 11B.

Comparing the invention in FIG. 2 to existing design in FIG. 1, the pure cylinder 12B is in sharp contrast to liner 12A. Cylinder 12B can now be made from readily available tubing, only requiring a small groove 18 to be machined prior to welding to head 11B. The clean cylinder presents no stress risers or hot spots near the head. The small groove is exposed to reduced stress and temperature at the end of the expansion stroke of the piston in the cylinder (not shown for clarity).

The differences in coolant jackets, 13A and 13B are also in sharp contrast. Both are thin wall because of the reduced pressure and temperature requirements, but a seal recess, a flexible coolant port and flow restrictions are all incorporated into 13B coolant jacket compared to the complexity of 13A.

The repair and maintenance of the invention is substantially simplified. When the cylinder 12B wears, the coolant jacket 13B is disconnected and the cylinder 12B is cut off.

Once removed the cylinder 12B could be rebuilt and enlarged to increase the displacement more easily than liner 12A because of the clean design. The cylinder 12B could also be squeezed back to its standard bore. Liner 12A, on the other hand, could not be squeezed back because of the integration of the water jacket 13A and the liner 12A.

In two-stroke engines, the cylinder 10A or 10B is provided with an air induction system which comprises circumferential orifices 16A or 16B as shown in dotted line in FIGS. 1 and 2 respectively. Termination of the coolant water jacket 13B prior to these orifices in cylinder 12B reduces the thickness of the orifice 16B compared to orifice 16A. This reduces pressure losses further increasing the volumetric efficiency of the cylinder 12B and directionalizing the airflow path within the cylinder 12B through the orifices 16B.

While the preferred embodiment of the invention has been described and modifications thereto have been suggested, other applications may be devised and other changes could be made without departing from the spirit of the invention and the scope of the appended claims.

What is claimed is:

1. In combination with a high-powered reciprocating piston internal combustion engine, an internal combustion cylinder assembly comprising:

a cylinder head made of weldable material;

a cylinder liner for containing and guiding a reciprocating piston of said engine, said cylinder liner and said cylinder head forming a welded structural unit, a coolant jacket adapted to receive a cooling fluid, mounted on and surrounding said cylinder liner, said jacket being attached to said cylinder head and detachably supported by said cylinder liner, and forming a cooling chamber around said cylinder liner;

means to supply said cooling fluid to said cooling chamber and to discharge said cooling fluid therefrom.

2. The cylinder assembly as set forth in claim 1, wherein said cylinder liner and said cylinder head are made of 3. The cylinder assembly as set forth in claim 2, wherein said cylinder liner is made from combustion steel tubing, the interior whereof has been surface hardened.

4. The cylinder aassembly as set forth in claim 1, wherein said jacket and cooling chamber do not extend beyond the combustion length.

5. The cylinder assembly as set forth in claim 1, wherein said cylinder liner and said cylinder head are joined by welding.

6. The cylinder assembly as set forth in claim 1, wherein said jacket is detachably secured to said cylinder liner by means of a retainer ring engaging a groove machined in the exterior wall of said cylinder liner.

7. The cylinder assembly as set forth in claim 6, wherein said cylinder liner further comprises air induction orifices along the perimeter thereof, said groove being machined approximately above said orifices between said cylinder head and said orifices.

8. The cylinder assembly as set forth in claim 1, wherein said means to supply and discharge cooling fluid comprise:

a cooling fluid supply;

a flexible attachment from said coolant supply to said cooling chamber; and an interconnecting discharge coolant port in said cylinder head for establishing communication between said cooling chamber and said cylinder head.

9. The cylinder assembly as set forth in claim 1, wherein said means to supply and discharge cooling fluid comprise:

a pressurized cooling fluid supply;

a first interconnecting port for passing cooling fluid from said supply to said cooling chamber; and a second interconnecting coolant port in said cylinder head for discharging said cooling fluid from said cooling chamber and said cylinder head.

* * * * *